US005921219A

United States Patent [19]

Fröhlich et al.

[11] Patent Number: 5,921,219

[45] Date of Patent: Jul. 13, 1999

[54] METHOD AND DEVICE FOR CONTROLLING AN INTERNAL COMBUSTION ENGINE

[75] Inventors: Johann Fröhlich, Landshut; Hong Zhang, Regensburg, both of Germany

[73] Assignee: Siemens Aktiengesellschaft, Munich, Germany

[21] Appl. No.: 09/048,565

[22] Filed: Mar. 26, 1998

[30] Foreign Application Priority Data

Mar. 26, 1997 [DE] Germany ..... 197 12 843

[51] Int. Cl.[6] ..... F02D 7/00

[52] U.S. Cl. ..... 123/399; 123/350

[58] Field of Search ..... 123/399, 350

[56] References Cited

U.S. PATENT DOCUMENTS

| | | | |
|---|---|---|---|
| 4,353,339 | 10/1982 | Collonia | 123/350 |
| 4,359,028 | 11/1982 | Fiala | 123/350 |
| 5,245,966 | 9/1993 | Zhang et al. | 123/350 |
| 5,391,127 | 2/1995 | Nishimura | 123/350 |
| 5,676,112 | 10/1997 | Bauer et al. | 123/350 |
| 5,692,472 | 12/1997 | Bederna et al. | 123/350 |

FOREIGN PATENT DOCUMENTS

| | | |
|---|---|---|
| 35 26 409 A1 | 2/1986 | Germany . |
| 36 21 555 A1 | 1/1988 | Germany . |
| 36 34 551 A1 | 4/1988 | Germany . |
| 37 38 719 A1 | 7/1988 | Germany . |
| 41 41 947 A1 | 6/1993 | Germany . |

*Primary Examiner*—John Kwon

*Attorney, Agent, or Firm*—Herbert L. Lerner; Laurence A. Greenberg

[57] ABSTRACT

A method and device for controlling an internal combustion engine includes a pedal position transmitter which registers the pedal position of a gas pedal. An estimated value of a desired torque to be applied at a clutch is derived cyclically from the pedal position and at least one operating variable of the internal combustion engine. A set point of the desired torque is ascertained as a function of an estimated value of the desired torque. A change over time of the set point (TQ_REQ_EST) of the desired torque is limited to a predefined change value (AW) while the set point remains in a predefined value range about the zero value of the desired torque.

10 Claims, 5 Drawing Sheets

METHOD AND DEVICE FOR CONTROLLING AN INTERNAL COMBUSTION ENGINE

BACKGROUND OF THE INVENTION

Field of the Invention

The invention relates to a method and device for controlling an internal combustion engine. The method and device use a gas pedal position transmitter for registering a gas pedal position of a gas pedal associated with the internal combustion engine and cyclically deriving an estimated value of a desired torque to be applied at a clutch from the gas pedal position and at least one operating variable of the internal combustion engine.

A control system for an internal combustion engine is disclosed by German Patent Application DE 41 41 947 A1. In the application, provision is made for a pedal position transmitter which registers the pedal position of a gas pedal. A driving style is derived from the pedal position. Depending on the driving style and further variables, an intended clutch torque, which represents the torque to be outputted from the engine at the clutch, is calculated. An indicated torque is ascertained as a function of the intended clutch torque and a torque loss. The torque loss takes into account losses as a result of friction and contributions from ancillary units, such as an air conditioning system, a generator or a power steering system.

SUMMARY OF THE INVENTION

It is accordingly an object of the invention to provide a method and a device for controlling an internal combustion engine, which overcome the above-mentioned disadvantages of the prior art devices and methods of this general type, and with which an internal combustion engine can be controlled conveniently, even in non-steady state operation.

With the foregoing and other objects in view there is provided, in accordance with the invention, a method for controlling an internal combustion engine, which includes providing a pedal position transmitter for registering a gas pedal position of a gas pedal associated with an internal combustion engine; deriving cyclically an estimated value of a desired torque to be applied at a clutch from the gas pedal position and at least one operating variable of the internal combustion engine; ascertaining a set point of the desired torque as a function of the estimated value of the desired torque; limiting a change in the set point of the desired torque over time to a predefined change value if the set point remains within a predefined value range of the set point around a zero value of the desired torque; and deriving an actuating signal for at least one actuator of the internal combustion engine from the set point of the desired torque.

The method is distinguished by the fact that, within a predefined value range around the zero value of the desired torque, a change of the set point(s) of the desired torque over time is limited to a predefined change in value. In the event of an abrupt transition from an overrun operation of the internal combustion engine to an acceleration, and vice versa, a reversal occurs in the power flow in a drive train of a vehicle in which the internal combustion engine is disposed. Since the gear wheels of a transmission of the drive train intermesh with a certain clearance, the reversal of the power flow leads to an impact on the gear wheels, which is transmitted to the drive wheels of the motor vehicle via an output drive shaft of the transmission. This impact is noticed by the driver as an unpleasant jolting movement. By limiting the change of the set points of the desired torque over time at the clutch, the impact is damped to such an extent that the driver does not notice much of an abrupt change. The value range in which the time change of the set points of the desired torque is limited is preferably selected to be so small that the reversal of the power flow takes place reliably only in this range of values. Outside the range of values, the desired torque is then set very rapidly.

In accordance with an added feature of the invention, there is the step of limiting a rise in the set point of the desired torque to the change value until a time derivative of a rotational speed falls below a first threshold value when the set point remains within the value range. A particularly rapid and simultaneously convenient setting of the desired torque is achieved if, in the value range, a rise in the set points of the desired torque is limited to the change value increment until the time derivative of the rotational speed falls below a first threshold value. This ensures that the limiting is carried out only until the load impact has taken place.

In accordance with an additional feature of the invention, there is the step of limiting a fall in the set point of the desired torque to the change value until a time derivative of a rotational speed exceeds a second threshold value when the set point remains within the value range.

In accordance with another feature of the invention, there is the step of setting the change value in dependence on at least one of a rotational speed, a transmission ratio of a transmission, an intake air temperature and a cooling water temperature.

In accordance with another added feature of the invention, there is the step of filtering the set point of the desired torque by a filter whose time constant depends on a rotational speed if the set point is outside the value range. In a further advantageous refinement of the invention, the set points of the desired torque are filtered outside the predefined value range. To this end, provision is made for a filter whose time constant depends on the rotational speed. Jolting oscillations are thus suppressed. Jolting oscillations are produced by the engine block being excited into oscillations close to its inherent frequency. The set point of the desired torque can be set in a straightforward way by influencing the air mass flow, the ignition angle or the air number, while minimizing the emissions.

In accordance with another additional feature of the invention, there is the step of determining the time constant from the rotational speed and at least one of a transmission ratio of a transmission and an intake air temperature.

In accordance with a further added feature of the invention, there is the step of determining the time constant also in dependence on whether a last-ascertained set point of the desired torque is less than a first limiting value of the value range or is greater than a second limiting value of the value range.

In accordance with a further additional feature of the invention, there is the step of determining the time constant also in dependence on whether a last-ascertained set point is greater or less than a current set point of the desired torque.

In accordance with yet another feature of the invention, there is the step of ascertaining a torque lead having a value depending on a last-ascertained set point of the desired torque, a current estimated value of the desired torque and a rotational speed.

With the foregoing and other objects in view there also is provided, in accordance with the invention, a device for controlling an internal combustion engine, including a gas pedal position transmitter which registers a pedal position of a gas pedal; first means for deriving an estimated value of a desired torque residing at a clutch from the gas pedal position and at least one operating variable of an internal combustion engine; second means for ascertaining a set point of the desired torque as a function of an estimated value of the desired torque; third means for limiting a change of the set point of the desired torque over time to a predefined change value if the set point is within a predefined value range of the set point about a zero value of the desired torque; and fourth means for deriving an actuating signal for at least one actuator of the internal combustion engine from the set point of the desired torque.

Other features which are considered as characteristic for the invention are set forth in the appended claims.

Although the invention is illustrated and described herein as embodied in a method and device for controlling an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
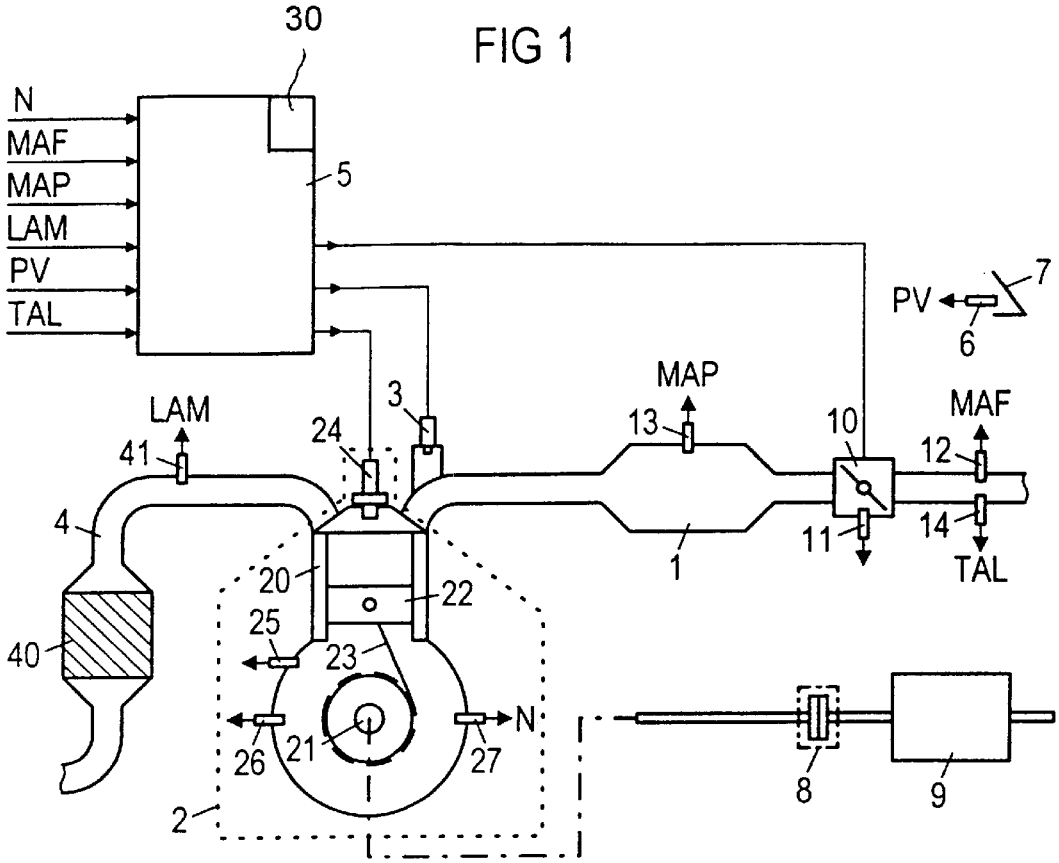
FIG. 1 is a diagrammatic and schematic view of an internal combustion engine with a control device for controlling the internal combustion engine according to the invention.

Elements of identical construction and function are provided with the same reference symbol and will in each case be described only once. Referring now to the figures of the drawing in detail and first, particularly, to FIG. 1 thereof, there is shown an internal combustion engine which has an intake tract 1, in which a throttle 10 is located, and an engine block 2, which has a cylinder 20 and a crankshaft 21. A piston 22, a connecting rod 23 and a spark plug 24 are assigned to the cylinder 20. The connecting rod 23 is connected to the piston 22 and to the crankshaft 21.

An injection valve 3 is provided, and is assigned to an individual injection system and disposed on the intake tract 1 close to the cylinder 20. The internal combustion engine further includes an exhaust gas tract 4, in which a catalytic converter 40 is disposed. In FIG. 1, the internal combustion engine is illustrated with one cylinder 20. However, it preferably has a plurality of cylinders. The injection valve 3 can also be assigned to a central injection system or to a direct inject system.

A control device 5 for the internal combustion engine is provided, and has assigned to it sensors which register various measured variables and in each case ascertain the measured value of the measured variable. The control device 5 ascertains one or more actuating signals, each of which controls an actuating device as a function of at least one measured variable.

The sensors are a pedal position transmitter 6 which registers a pedal position PV of a gas pedal 7, a throttle position transmitter 6 which registers a degree of opening THR of the throttle 10, an air mass meter 12 which registers an air mass flow MAF, an intake pipe pressure sensor 13 which registers an intake pipe pressure MAP, a first temperature sensor 14 which registers an intake air temperature TAL, a second temperature sensor 25 which registers a cooling water temperature TCO, a third temperature sensor 26 which registers an oil temperature TOIL, a rotational speed transmitter 27 which registers a rotational speed N of the crankshaft 21, and an oxygen probe 41 which registers the residual oxygen content of the exhaust gas and assigns to the latter an air number LAM. Depending on the embodiment of the invention, any desired subset of the sensors or even additional sensors may be present. In particular, in the case of a cost-effective embodiment of the invention, it is possible to dispense with the air mass meter 12 and/or the intake pipe pressure sensor 13.

The operating variables include the measured variables and variables derived from these, such as an ambient pressure. The actuating devices each have an actuating drive and an actuator. The actuating drive is an electric motor drive, an electromagnetic drive, a mechanical drive or any further drive known to those skilled in the art. The actuators are configured as the throttle 10, as the injection valve 3, as the spark plug 24, as an unillustrated changeover device between two different intake pipe lengths or as a device for adjusting a lift profile, a lift start or a lift end of a gas exchange valve. In the text which follows, reference is made to the actuating devices in each case with the associated actuator.

The control device 5 is preferably configured as an electronic engine controller. However, it may also have a plurality of control devices which are electrically conductively connected to each other, for example via a bus system.

The crankshaft 21 can be coupled to a transmission 9 via a clutch 8. If the transmission 9 is configured as an automatic transmission, then the clutch 9 is configured as a converter lockup clutch, preferably having a hydrodynamic converter.

Figure 2:
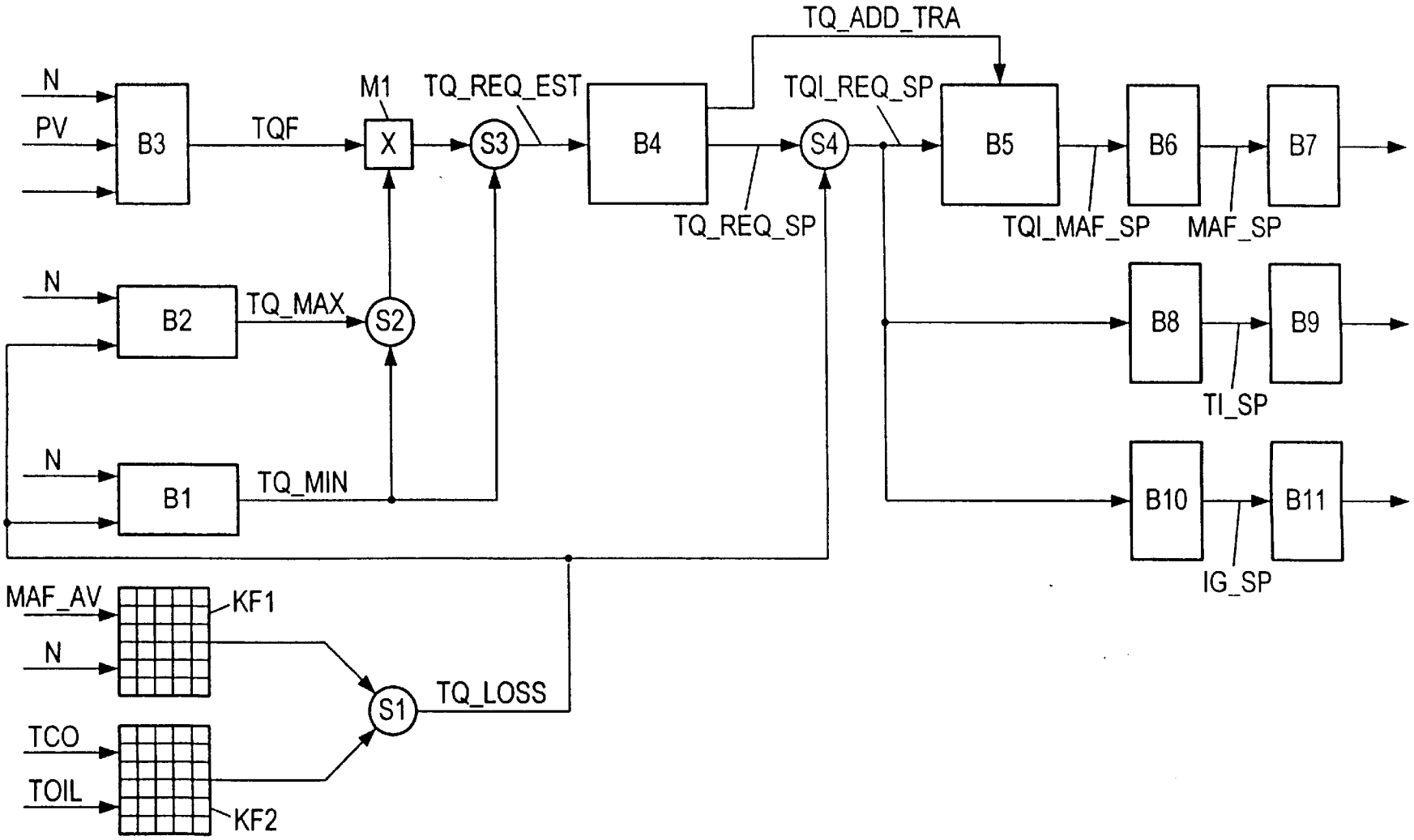
FIG. 2 is a block diagram of the control device.

FIG. 2 shows a block diagram of the control device 5. A control device 5 of this type is also described in the unpublished German Patent Application No. 196 12 455.7 from the same applicant, whose content in this regard is herewith incorporated by reference. From a first characteristic map KF1, a first contribution to the torque loss TQ_LOSS is ascertained as a function of the measured value MAF_AV of the air mass flow and the rotational speed N of the crankshaft. The first contribution takes into account charge-change losses. A second contribution to the torque loss TQ_LOSS is ascertained from a second characteristic map KF2 as a function of the cooling water temperature TCO and/or the oil temperature TOIL. The first contribution and the second contribution are added at a first summing point S1. For the torque loss TQ_LOSS it is also further possible to take into account a torque requirement of ancillary units, such as a generator or an air-conditioning compressor.

In a first block Bi, a minimum torque TQ_MIN which can be applied to the clutch 8 at a minimum, is ascertained as a function of the torque loss TQ_LOSS and of the rotational speed N.

In a block B2, a maximum torque TQ_MAX, which can be applied to the clutch 8, is ascertained as a function of the torque loss TQ_LOSS and of the rotational speed N. In a convenient embodiment of the control device 5, the maximum torque TQ_MAX is additionally ascertained as a function of the ambient pressure and of the intake air temperature TAL.

In a block B3, a torque factor TQF is ascertained as a function of the rotational speed N and the pedal position PV. The torque factor TQF preferably represents a dimensionless variable having a value range between 0 and 1. The torque TQF is preferably ascertained from a characteristic map. In addition, it is also further possible for an actuating signal of a driving speed controller to be taken into account.

At a multiplier point M1, the torque factor TQF is linked by multiplication with the difference between the maximum torque TQ_MAX and the minimum torque TQ_MIN derived at the summing point S2. The minimum torque TQ_MIN is then also added at the summing point S3. Present at the output of the summing point S3 is an estimated value TQ_REQ_EST of the desired torque, which is desired at the clutch 8 by the driver.

In a block B4, a set point TQ_REQ_SP of the desired torque and a torque lead TQ_ADD_TRA are ascertained, specifically as a function of the estimated value TQ_REQ_EST of the desired torque. The functioning of the block B4 will be described further below with reference to FIGS. 3 to 5.

At the summing point S4, a set point TQI_REQ_SP of an indicated desired torque is ascertained. To this end, the set point TQ_REQ_SP of the desired torque and the torque loss TQ_LOSS are added.

In a block B5, a set point TQI_MAF_SP of the torque that is to be influenced via the air mass flow is ascertained as a function of the set point TQI_REQ_SP of the indicated torque. It is preferable if the set point TQI_MAF_SP of the torque that is to be influenced via the air mass flow is additionally ascertained as a function of the torque lead TQ_ADD_TRA and also further lead torques, for example for an idling controller, for a catalytic converter heater or for a traction control system. In addition, the set point TQI_MAF_SP of the torque that is to be influenced via the air mass flow is limited to a maximum permissible value which is predefined by an anti-slip control system, a rotational speed limiting system or a catalytic converter protection function.

In a block B6, a set point MAF_SP of the air mass flow is ascertained as a function of the set point TQI_MAF_SP of the torque that is to be influenced via the air mass flow. In a block B7, the actuating signal for setting a desired degree of opening of the throttle 10 is ascertained.

In a block B8, a set point TI_SP of an injection time for the injection valve 3 is ascertained as a function of the set point TQI_REQ_SP of the indicated desired torque. In the block B9, an actuating signal for controlling the injection valve 3 is ascertained as a function of the set point TI_SP of the injection time.

In the block B10, a set point IG_SP of an ignition angle is ascertained as a function of the set point TQI_REQ_SP of the indicated desired torque. In the block B11, an appropriate actuating signal for controlling the spark plug 24 is ascertained as a function of the set point IG_SP of the ignition angle.

The actuating signals for the throttle 10, the spark plug 24 and the injection valve 3 are preferably ascertained from characteristic maps.

Figure 3:
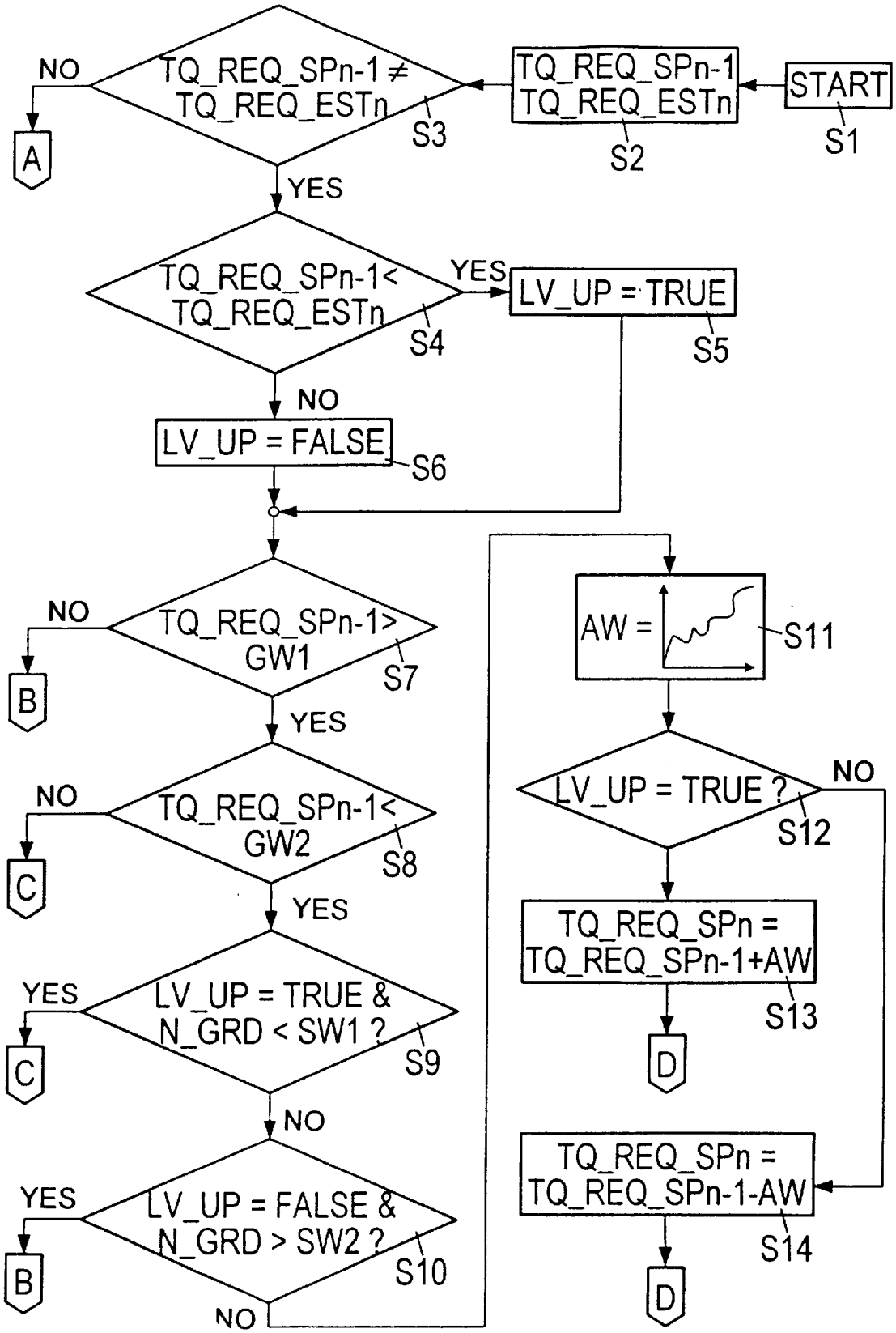
FIG. 3 is a flow diagram of a program sequence for ascertaining a torque set point of a desired torque.

FIG. 3 shows a flow diagram of a program sequence for ascertaining the set point TQ_REQ_SP of the desired torque, as it is preferably stored in the control device 5 in the form of a computer program. The program sequence is started in a step S1. The start is carried out cyclically, for example every 10 ms, during the operation of the internal combustion engine.

In a step S2, the current estimated value $TQ_REQ_EST_n$ is ascertained, and the set point $TQ_REQ_SP_{n-1}$, of the desired torque that was ascertained the last time the program sequence was started is read from memory 30.

In a step S3, a check is made as to whether the set point $TQ_REQ_SP_{n-1}$ is not equal to the current estimated value $TQ_REQ_EST_n$. Alternatively, a check is made here as to whether the set point $TQ_REQ_SP_{n-1}$ and the current estimated value $TQ_REQ_EST_n$ differ by more than a hysteresis value. If the condition of step S3 is fulfilled, then a branch is made in step S4, in which a check is made as to whether the set point $TQ_REQ_SP_{n-1}$ is less than the current estimated value $TQ_REQ_EST_n$. If this is so, then a variable LV_UP is filled with the value TRUE in a step S5. If this is not so, then the variable LV_UP is filled with the value FALSE in a step S6.

In a step S7, a check is made as to whether the set point $TQ_REQ_SP_{n-1}$ is greater than a first limiting value GW1. The first limiting value GW1 is permanently predefined, specifically in such a way that it is ensured that an actual value of the torque at the clutch is still less than a zero value of the actual torque if the set point TQ_REQ_SP exhibits the first limiting value GW1. If this is so, then a branch is made in step S8, in which a check is made as to whether the set point $TQ_REQ_SP_{n-1}$ is less than a second limiting value GW2. If this is so, then processing is continued in a step S9. In the event of a transition from negative values of the actual torque at the clutch to positive values, a reversal of the power flow in the drive train occurs. This briefly results in a sharp rise in the derivative N_GRD of the rotational speed N and then to a brief sharp fall in the derivative N_GRD of the rotational speed N. In step S9, a check is made as to whether the variable LV_UP has the value TRUE and whether the derivative N_GRD of the rotational speed N is less than a first threshold value SW1. A check is advantageously also made in step S9 as to whether the value ascertained last and/or before that for the derivative N_GRD of the rotational speed N is or are greater than the current derivative N_GRD of the rotational speed N, or whether the second derivative of the rotational speed is less than a threshold value SW'. If the condition of step S9 is fulfilled, then the reversal of the power flow in the drive train has already taken place, and processing is continued at a junction point C.

If this is not so, then processing is continued in the step S10, in that a check is made as to whether the variable LV_UP has the value FALSE and whether the derivative N_GRD of the rotational speed N is greater than a second threshold value SW2. A check is also advantageously made in step S10 as to whether the value ascertained last and/or before that for the derivative N_GRD of the rotational speed N is or are less than the current derivative N_GRD of the rotational speed N, or whether the second derivative of the rotational speed is greater than a threshold value SW".

If the condition of step S10 is fulfilled, then in the event of a fall in the actual torque at the clutch, the reversal of the power flow has already taken place, and processing is continued at a junction point B. If this is not so, then a change value AW is ascertained in a step S11. The change value AW may be permanently predefined. However, in a preferred embodiment the value is ascertained from a fourth characteristic map as a function of the rotational speed N and/or the transmission ratio of the transmission 9 and/or an intake air temperature TAL and/or a cooling water temperature TCO.

In step S12, a check is made as to whether the variable LV_UP has the value TRUE. If this is so, then in step S13 the current set point $TQ_REQ_SP_n$ is ascertained by adding the change value AW to the set point $TQ_REQ_SP_{n-1}$ of the desired torque.

If the condition of step S12 is not fulfilled, then in a step S14 the current set point $TQ_REQ_SP_n$ is ascertained by subtracting the change value AW from the set point $TQ_REQ_SP_{n-1}$ of the desired torque. Both in step S13 and in step S14, the change over time of the set point TQ_REQ_SP of the desired torque is limited. In this way a load impact, which is effected by the reversal of the power flow in the transmission, is damped to such an extent that it is barely perceived by the driver.

Figure 4:
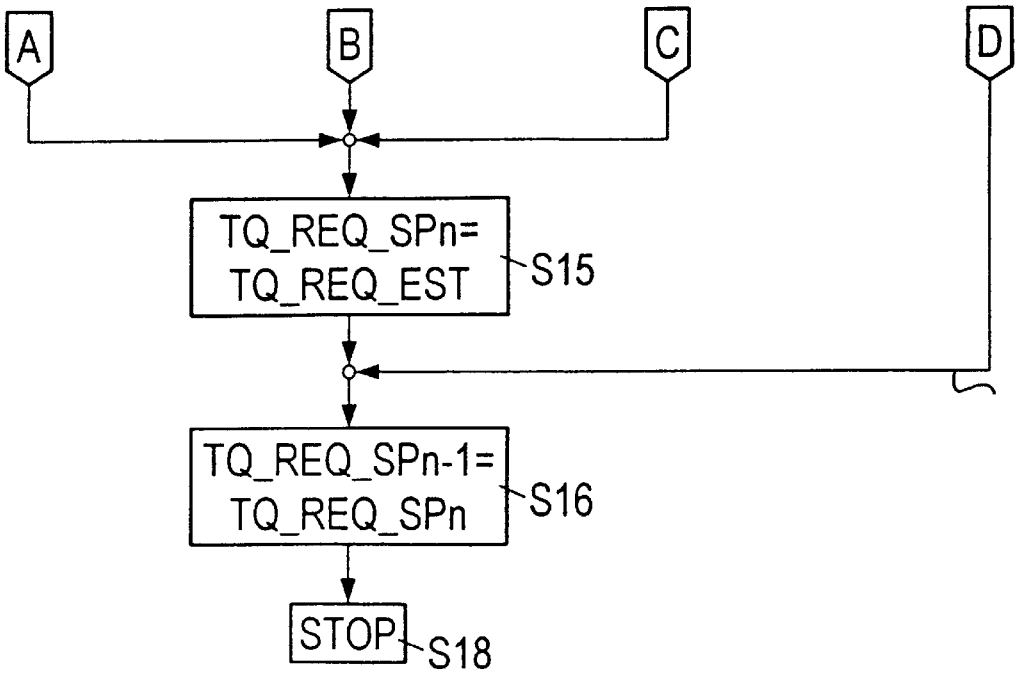
FIG. 4 is a flow diagram of a first embodiment of a second part of the flow diagram according to FIG. 3.

In a step S15 shown in FIG. 4, the estimated value TQ_REQ_EST of the desired torque is allocated to the current set point $TQ_REQ_SPN_n$ of the desired torque. Processing is continued in this step if the condition of step S3 is not fulfilled or the condition of step S7 or S8 is not fulfilled or the conditions of steps S9 or S10 are fulfilled.

In a step S16, the current set point $TQ_REQ_SP_n$ is allocated to the set point $TQ_REQ_SP_{n-1}$. The set point $TQ_REQ_SP_{n-1}$ is stored in the unillustrated memory. The program sequence is stopped in step S18.

Figure 5:
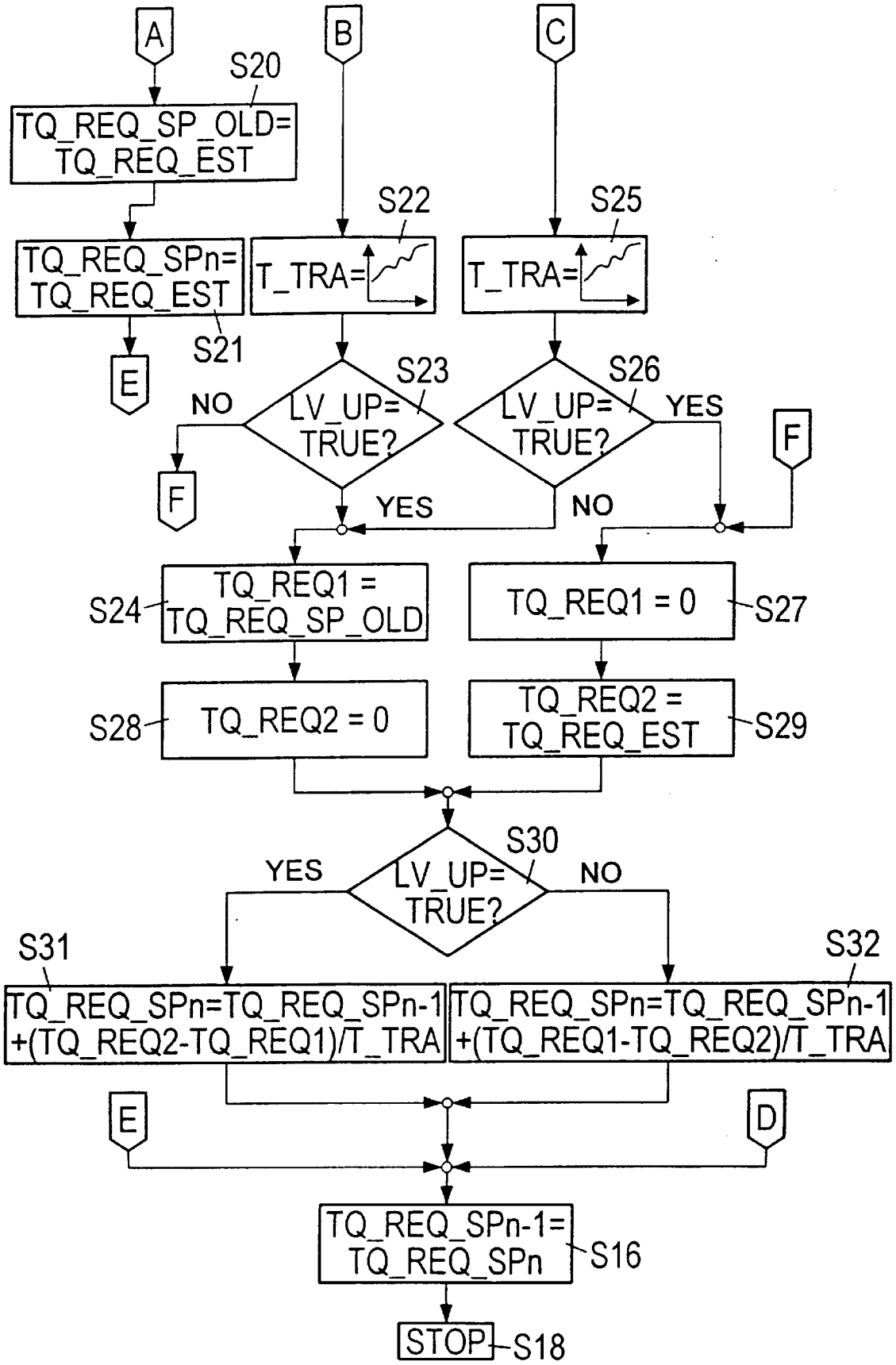
FIG. 5 is a flow diagram of a second embodiment of the second part of the flow diagram according to FIG. 3.
Figure 6:
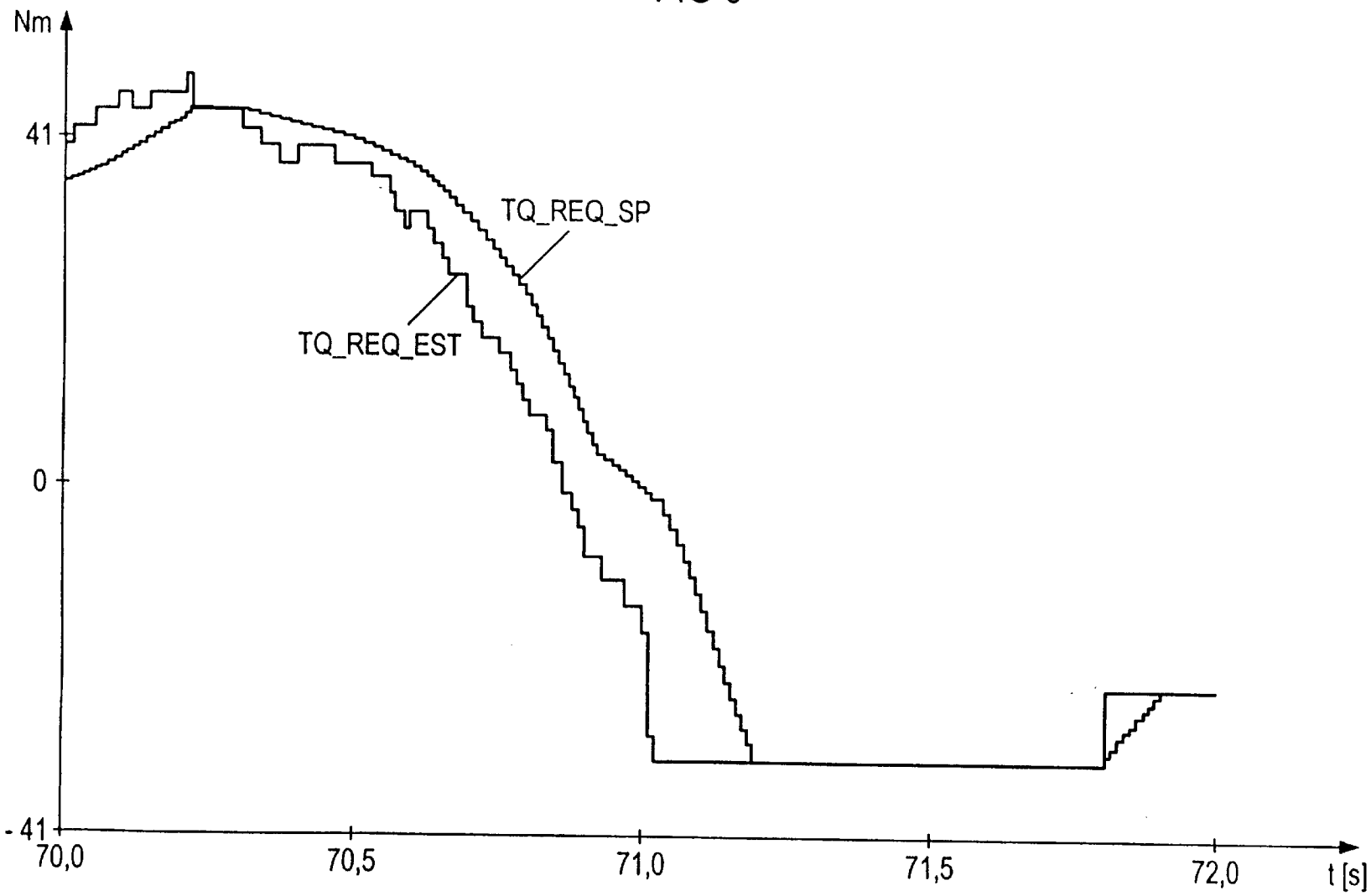
FIG. 6 is a graph of a curve of an estimated value and of the set point of the desired torque plotted against time t.

FIG. 5 shows a second embodiment of the program sequence. Parts that are identical to those of FIGS. 3 and 4 are not described again.

If the condition of step S3 is not fulfilled, that is to say the set point TQ_REQ_SP is stationary, then processing is continued in a step S20. In the step S20, the estimated value TQ_REQ_EST of the desired torque is allocated to an old value TQ_REQ_SP_OLD of the desired torque. In a step S21, the estimated value TQ_REQ_EST of the desired torque is allocated to the current set point $TQ_REQ_SP_n$.

If the condition of step S7 is not fulfilled or the condition of step S10 is fulfilled, then processing is continued in a step S22. In step S22, a time constant T_TRA is ascertained from a fifth characteristic map as a function of the rotational speed N and/or the transmission ratio of the transmission 9 and/or the intake air temperature TAL. By use of the fifth characteristic map, the time constant T_TRA is in each case determined in such a way that there is no risk of making the internal combustion engine too lean at low rotational speed, and also that no misfires occur because of a mixture that is no longer capable of ignition.

If the condition of step S8 is not fulfilled or the condition of step S9 is fulfilled, then processing is continued in a step S25, in that the time constant T_TRA is ascertained from a sixth characteristic map as a function of the rotational speed N and/or the transmission ratio of the transmission 9 and/or the intake air temperature TAL. In a simple embodiment of the invention, the fifth and sixth characteristic maps are identical. In a particularly convenient embodiment of the invention, a fifth characteristic map KF5, KF5' and a sixth characteristic map KF6, KF6' are in each case provided, depending on whether the variable LV_UP has the value TRUE or FALSE.

In a step S23 and a step S26, a check is made as to whether the variable LV_UP has the value TRUE. If this is the case in step S23 or not the case in step S26, then in a step S24, the old value TQ_REQ_SP_OLD of the desired torque is allocated to a variable TQ_REQ1 and, in a step S28, the value zero is allocated to a variable TQ_REQ2. Alternatively, the first or the second limiting value can also be allocated to the variable TQ_REQ2.

If the condition of step S23 is not fulfilled or the condition of step S26 is fulfilled then, in a step S27, the value zero is allocated to the variable TQ_REQ1 and in a step S29, the estimated value TQ_REQ_EST of the desired torque is allocated to the variable TQ_REQ2. Alternatively, it is also possible for the first or second limiting value to be allocated to the variable TQ_REQ1.

If, in a step S30, the variable LV_UP has the value TRUE, then, in a step S31, the current set point $TQ_REQ_SP_n$ of the desired torque is ascertained in accordance with the computing rule specified there. If the condition of step S30 is not fulfilled, then, in step S32, the current set point $TQ_REQ_SP_n$ of the desired torque is ascertained in accordance with the computing rule specified there.

The steps S22 to S32 implement a filter with the time constant T_TRA, which filters the set points of the desired torque outside the predefined value range. The filter damps the frequency components of the set points TQ_REQ_SP of the desired torque which correspond to the inherent frequency of the system formed of the engine block and its mounting. In this way, jolting oscillations of the vehicle, which are sensed as unpleasant by the driver, can be effectively damped.

It is preferable for the torque lead (TQ_ADD_TRA) to be calculated as a function of a difference between the estimated value (TQ_REQ_EST) and the set point (TQ_REQ_SP) of the desired torque and a torque contribution that is ascertained from a characteristic map as a function of the rotational speed, the torque lead being limited to a lower limiting value.

The invention is not restricted to the embodiments described herein and the characteristic maps are ascertained by stationary measurements on an engine test stand or by driving trials.

We claim:

1. A method for controlling an internal combustion engine, which comprises:

registering a gas pedal position of a gas pedal associated with an internal combustion engine with a pedal position transmitter;

deriving cyclically an estimated value of a desired torque to be applied at a clutch from the gas pedal position and at least one operating variable of the internal combustion engine;

ascertaining a set point of the desired torque as a function of the estimated value of the desired torque;

limiting a change in the set point of the desired torque over time to a predefined change value if the set point is within a predefined value range of the set point around a zero value of the desired torque; and deriving an actuating signal for at least one actuator of the internal combustion engine from the set point of the desired torque.

2. The method according to claim 1, which comprises limiting a rise in the set point of the desired torque to the predefined change value until a time derivative of a rotational speed falls below a first threshold value if the set point remains within the predefined value range.

3. The method according to claim 1, which comprises limiting a fall in the set point of the desired torque to the predefined change value until a time derivative of a rotational speed exceeds a second threshold value if the set point remains within the predefined value range.

4. The method according to claim 1, which comprises setting the predefined change value in dependence on at least one of a rotational speed, a transmission ratio of a transmission, an intake air temperature and a cooling water temperature.

5. The method according to claim 1, which comprises filtering the set point of the desired torque by a filter whose time constant depends on a rotational speed if the set point is outside the predefined value range.

6. The method according to claim 5, which comprises determining the time constant from the rotational speed and at least one of a transmission ratio of a transmission and an intake air temperature.

7. The method according to claim 5, which comprises determining the time constant also in dependence on whether a last-ascertained set point of the desired torque is less than a first limiting value of the predefined value range or is greater than a second limiting value of the predefined value range.

8. The method according to claim 5, which comprises determining the time constant also in dependence on whether a last-ascertained set point is greater or less than a current set point of the desired torque.

9. The method according to claim 1, which comprises ascertaining a torque lead having a value depending on a last-ascertained set point of the desired torque, a current estimated value of the desired torque and a rotational speed.

10. A device for controlling an internal combustion engine, comprising:

a gas pedal position transmitter for registering a pedal position of a gas pedal;

first means for deriving an estimated value of a desired torque residing at a clutch from said gas pedal position and at least one operating variable of an internal combustion engine;

second means for ascertaining a set point of said desired torque as a function of an estimated value of said desired torque;

third means for limiting a change of said set point of said desired torque over time to a predefined change value if said set point is within a predefined value range of said set point about a zero value of said desired torque; and fourth means for deriving an actuating signal for at least one actuator of the internal combustion engine from said set point of said desired torque.

* * * * *